US010030507B2

(12) United States Patent
Nyhavn et al.

(10) Patent No.: US 10,030,507 B2
(45) Date of Patent: Jul. 24, 2018

(54) GAS WELL INFLOW DETECTION METHOD

(71) Applicant: RESMAN AS, Ranheim (NO)

(72) Inventors: Fridtjof Nyhavn, Trondheim (NO); Erlend Fævelen, Trondheim (NO)

(73) Assignee: RESMAN AS, Ranheim (NO)

( * ) Notice: Subject to any disclaimer, the term of this patent is extended or adjusted under 35 U.S.C. 154(b) by 376 days.

(21) Appl. No.: 14/782,209

(22) PCT Filed: Apr. 4, 2014

(86) PCT No.: PCT/NO2014/050048

§ 371 (c)(1),
(2) Date: Oct. 2, 2015

(87) PCT Pub. No.: WO2014/168483

PCT Pub. Date: Oct. 16, 2014

(65) Prior Publication Data

US 2016/0047231 A1 Feb. 18, 2016

Related U.S. Application Data

(60) Provisional application No. 61/810,098, filed on Apr. 9, 2013.

(30) Foreign Application Priority Data

Apr. 7, 2013 (NO) ..... 20130466

(51) Int. Cl.
*E21B 47/10* (2012.01)
*E21B 43/14* (2006.01)
(Continued)

(52) U.S. Cl.
CPC ..... *E21B 47/1015* (2013.01); *E21B 43/14* (2013.01); *E21B 43/16* (2013.01); *E21B 49/08* (2013.01)

(58) Field of Classification Search
CPC ..... E21B 43/14; E21B 43/16; E21B 47/1015; E21B 49/08
See application file for complete search history.

(56) References Cited

U.S. PATENT DOCUMENTS 5,063,772 A 11/1991 Wellington et al.
5,212,093 A 5/1993 Richardson et al.
(Continued)

FOREIGN PATENT DOCUMENTS

WO WO 2006/047478 A2 5/2006
WO WO 2012/057634 A1 5/2012
WO WO 2012/175669 A1 12/2012

*Primary Examiner* — Caroline N Butcher
(74) *Attorney, Agent, or Firm* — Birch, Stewart, Kolasch & Birch, LLP

(57) ABSTRACT

A method for detecting or mapping potential influx zones for gas from a geological formation to a gas well with a well head with a valve tree or a choke includes the following steps of: marking the potential influx zones with tracer systems with corresponding unique tracers—filling the gas well form the surface, through the well head with liquid wherein the tracers have affinity to the liquid, producing liquid form the well, consecutively sampling samples from the produced liquid, to analyze the samples to prove possible presence of one or more tracers or even measure the tracers concentrations. By performing the method, one may prove possible influx of a back flow of liquid from the influx zones that one assumes implies the gas pressure and the inflow of a gas form the influx zones.

8 Claims, 5 Drawing Sheets

Barefoot completion
(no steel in prod zone)

(51) Int. Cl.
*E21B 43/16* (2006.01)
*E21B 49/08* (2006.01)

(56) References Cited

U.S. PATENT DOCUMENTS

| | | | | |
|---|---|---|---|---|
| 6,645,769 | B2 * | 11/2003 | Tayebi | E21B 47/1015 166/246 |
| 2010/0000736 | A1 * | 1/2010 | Bour | E21B 33/124 166/281 |
| 2010/0195833 | A1 | 8/2010 | Priestley et al. | |
| 2013/0268198 | A1 * | 10/2013 | Nyhavn | E21B 27/02 702/6 |
| 2015/0001385 | A1 | 1/2015 | Perriat et al. | |

* cited by examiner

Barefoot completion
(no steel in prod zone)

Predrilled Production Liner
Slotted Production Liner or
Stand Alone Screen

Isolated Well Zones

GAS WELL INFLOW DETECTION METHOD

CROSS REFERENCE TO RELATED APPLICATIONS:

This application is the National Phase of PCT International Application No. PCT/NO2014/050048, filed on Apr. 04, 2014, which claims priority under 35 U.S.C. 119(e) to U.S. Provisional Application No. 61/810,098, filed on Apr. 09, 2013 and under 35 U.S.C. 119(a) to patent application Ser. No. 20130466, filed in Norway on Apr. 07, 2013, all of which are hereby expressly incorporated by reference into the present application.

CURRENT PROBLEM AND RELATED ART

In the prior art there are a lot of examples of marking of zones in petroleum wells, by so called tracers, for thereafter collecting liquid samples of the produced liquid to detect the tracers and measure their concentration in the produced liquid. In this way one may get an overview of which parts of the well constituting influx zones, and use such measures to control the production, for example by controlling valves in the separate zones in the well completion in the influx zones, possibly also by controlling the pressure during production.

Some generally conceptions related to tracers in petroleum wells are as follows: 1: Tracers (tr1, tr2, tr3, . . . ) are tracers or tracer molecules by itself. 2: Tracer systems (ts1, ts2, ts3, . . . ) are combination of a tracer and a polymer or another material carrier, that may be placed as a material unit in a well, preferably in a tracer system carrier. 3: A tracer system carrier (tc1, tc2, tc3, . . . ) is a mechanical component (part of the completion) that carries the tracer system.

Special Conditions of Tracers in a Gas Well

A gas well may be marked by tracers down hole to map the flow from potential influx zones. The gas (g) that is produced to the surface in a gaseous state may exist as a liquid state down hole, or at a gaseous state down hole as well, never the less, from this perspective it is the same gas. We refer to the gas and the liquid (g) as a fluid (g). The tracers intended to get in contact to the fluid (g) in its liquid state (g) down in the well may have a first affinity (a1) to the fluid (g) while it is in its liquid state, as a liquid (g), while this affinity may decrease to a second, weaker affinity (a2) to the gas (g), when the liquid (g) changes phase to gas (g) by decreases in pressure or temperature or both, or even when/if the speed increases as well. Generally one would sampled the gas either consecutively by time or consecutively by produce cumulative volume, and analyzed the samples by content of tracers to detect the tracers in the samples, or also to measure the tracer concentration in the samples. Note, there is a difference in detecting the tracers in the samples and to measure their concentration; the first is only to show that the tracers actually are in the samples, the second is to show the existence and additionally measure the concentration. The tracers sequenced arrival via the well head, designate the influx zones for influx of gas (g). An essential problem is that, if the well produces gas from one or more of the zones, the lower affinity of the tracer to the fluid (g) in gaseous state cause the tracers not to follow the gas (g) by gradually decreasing density, but attach to the well wall or the tubing or other parts of the completion, and remain in the well or be smeared into other fluids, especially fluids, in the well. In this way the gas production will have a poor tracer print.

SHORT SUMMARY OF THE INVENTION

The invention is to pump down into the well a liquid with affinity to the tracers placed in the influx zones in the well, produce the liquid with the attached tracers from the well, consecutively sampling the produced liquid, and by that, prove the tracers and their arrival in the fluid, for thereby to prove the influx in the influx zones, and in which such influx occur.

A definition of the invention is: a method for detecting (or map) potential influx zones (z1, z2, z3, . . . ) for gas (g) from a geological formation to a gas well (1) with a well head (b) with a valve tree or a choke (12), wherein the method comprises the following steps of:

- marking (100) the potential influx zones (z1, z2, z3, . . . ) with tracer systems (ts1, ts2, ts3, . . . ) with corresponding unique tracers(tr1, tr2, tr3, . . . )
- filling (200) the gas well form the surface, through the well head (b) with liquid (v) wherein the tracers (tr1, tr2, tr3, . . . ) have affinity (a) to the liquid (v),
- producing (300) liquid (v) form the well (1),
- consecutively sampling (400) samples (s1, s2, s3, . . . ) from the produced liquid (v),
- analyzing (500) the samples (s1, s2, s3, . . . ) to prove possible presence of one or more tracers (tr1, tr2, tr3, . . . ) or even measure the tracers concentrations (c1, c2, c3, . . . ).

The concentrations (c1, c2, c3, . . . ) of the tracers may be measured as a function of time or cumulative volume, and conduction lines may be drawn.

One may then prove possible influx of a back flow of liquid (v) from the influx zones (z1, z2, z3, . . . ) that one assume implies the gas pressure and the inflow of a gas (g) from the influx zones (z1, z2, z3, . . . ).

Another aspect, and a further summary of the invention, is that it is a method to control the production from a gas well by using the method above, that ends up in analyzing (500) the samples (s1, s2, s3, . . . ) to prove possible presence of one or more tracers (tr1, tr2, tr3, . . . ), or even measure the tracers concentrations (c1, c2, c3, . . . ) to control the production of the gas (g) after that the liquid (v) is taken out of the well (1), based on the analyzed samples (s1, s2, s3, . . . ).

Controlling the production is not necessarily to control by valves only, especially down hole valves, but that the analysis trigger a larger intervention wherein e.g a "patch" is put on a desired zone, or a well stimulation is performed, or performing one or more fracturing of one or more influx zones.

An alternative act as a consequence of the analysis, is to update the reservoir model based on the analysis, which is not an immediate and material act to the well flow, but with material consequence by producing the gas in a different way or sequence.

More specific, in an embodiment of the invention where the well is completed, controlling the production by controlling (610) valves (vz1, vz2, vz3, . . . ) for zone by zone, controlling (611) the influx from the influx zones (z1, z2, z3, . . . ).

Other supplementing steps and characteristics by the invention are given in the dependent claims. Such steps and characteristics may be performed in combination if they are not internally conflicting. For instance, one may combine sampling samples (si) consecutively by cumulative fluid volume, and one may operate at a completed well, and where the tracers (tr1, tr2, tr3, . . . ) are placed (110) in separate zones (zk1, zk2, . . . ) of the completion (12) or at, or in, the rock by the zones in the completion (12), i.e. that the zones are marked (110) according to the split of completions (12), and that one may control (600) the production of the gas (g), after the liquid (v) is taken out of the well (1), based on the analyzed samples (s1, s2, s3, . . . ) indicating influx of fluid (v) and by that assume the influx of the gas (g) in a similar way when the production of gas starts, e.g. bay controlling (610) the valves (vz1, vz2, vz3, . . . ) in the completion (12) for controlling (611) the influx from the influx zones (z1, z2, z3, . . . ) zone by zone. In this way one gain production from desired parts of the influx zones wherein the influx is at the highest at an early stage of the production and avoid production of gas from an influx zone wherein the pressure is lower, and possible preventing influx for undesired influx zones that are water producing.

It might be necessary to adjust to differences between the permeability of liquid and gas (relative permeability) when interpreting the back flow ability for gas.

A separate problem by cross flow is that there may occur flux from a zone with higher pressure than another zone in the same well with lower pressure. This situation may be relieved by closing down the well if there is a suspicion that there might be cross flows, fill up with the liquid (v), wait for an equilibrium of the pressure, then use the present method at the pressure equalized well. This may take several days or only a few hours. To get an impression of possible difference in pressure for the different influx zones one may use the method a first time at a higher flow rate (that gives a lower pressure), and a second time at a lower flow rate (giving a higher pressure), and deduce to the pressure differences between the influx zones.

SHORT FIGURE CAPTIONS

The invention is illustrated by the attached figures wherein

EMBODIMENTS OF THE INVENTION

Figure 1:
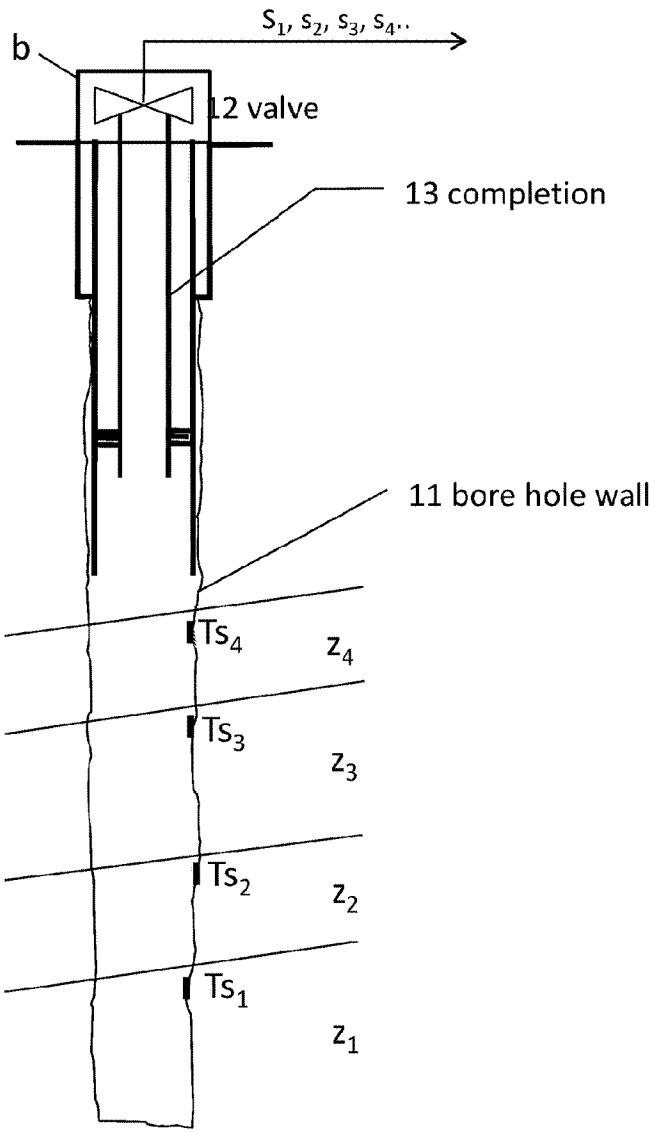
FIG. 1 is a simplified vertical section cut of a so called "barefoot" well with four placed tracer systems it the bore hole wall or shut into the formation at potential influx zones z1, z2, z3 and z4.

The present invention is a method for detecting (or map) potential influx zones (z1, z2, z3, . . . ) for gas (g) from a geological formation to a gas well (1) with a well head (b) with a valve tree or a choke (12), please see FIG. 1 for an overview.

The method comprises the following steps:

- marking (100) the potential influx zones (z1, z2, z3, . . . ) with tracer systems (ts1, ts2, ts3, . . . ) with corresponding unique tracers (tr1, tr2, tr3, . . . ) Such tracer systems may be polymer carriers doped in tracers. The tracers may be for flow independent diffusion release.
- then filling (200) the gas well form the surface, through the well head (b) with fluid (v) wherein the tracers (tr1, tr2, tr3, . . . ) have affinity (a) to the liquid (v), The liquid (v) may for instance be mainly water, diesel oil, or a regular liquid for use in gas wells. The main principle is that we know the composition and the physical properties, the fluid (v) will mainly be in a liquid state in the well during consideration. Preferably, one wish to special design the tracer release to the fluid (v), even if, not necessarily, one may prevent the release to other fluids than the fluid (v). As an alternative, one may fill the gas well from the surface, use one or more possible natural, present influx zones of water to the well, influx zones that one before natural production would try to reduce or close, flood the well from one of those zones to wet the rest of the zones with tracers, and then continue the method as below.
- then, producing (300) liquid (v), i.e. allowing the fluid (v) to flow controlled from the well (1) via the well head.
- further consecutively sampling (400) samples (s1, s2, s3, . . . ) from the produced liquid (v), while producing. Sampling may take place consecutively by cumulative fluid volume, or time, and draw up curves of their progress.
- a next step will be to analyzing (500) the samples (s1, s2, s3, . . . ) to prove possible presence of one or more tracers (tr1, tr2, tr3, . . . ), or even measure the tracers concentrations (c1, c2, c3, . . . ) thereof.

By performing the above mentioned steps, one may prove possible influx of back flow fluid (v) form the influx zones (z1, z2, z3, . . . ). Further, one may assume that the back flow of the fluid (v) implies a gas pressure that lead to inflow of gas (g) form the influx zones (z1, z2, z3, . . . ).

Figure 4:
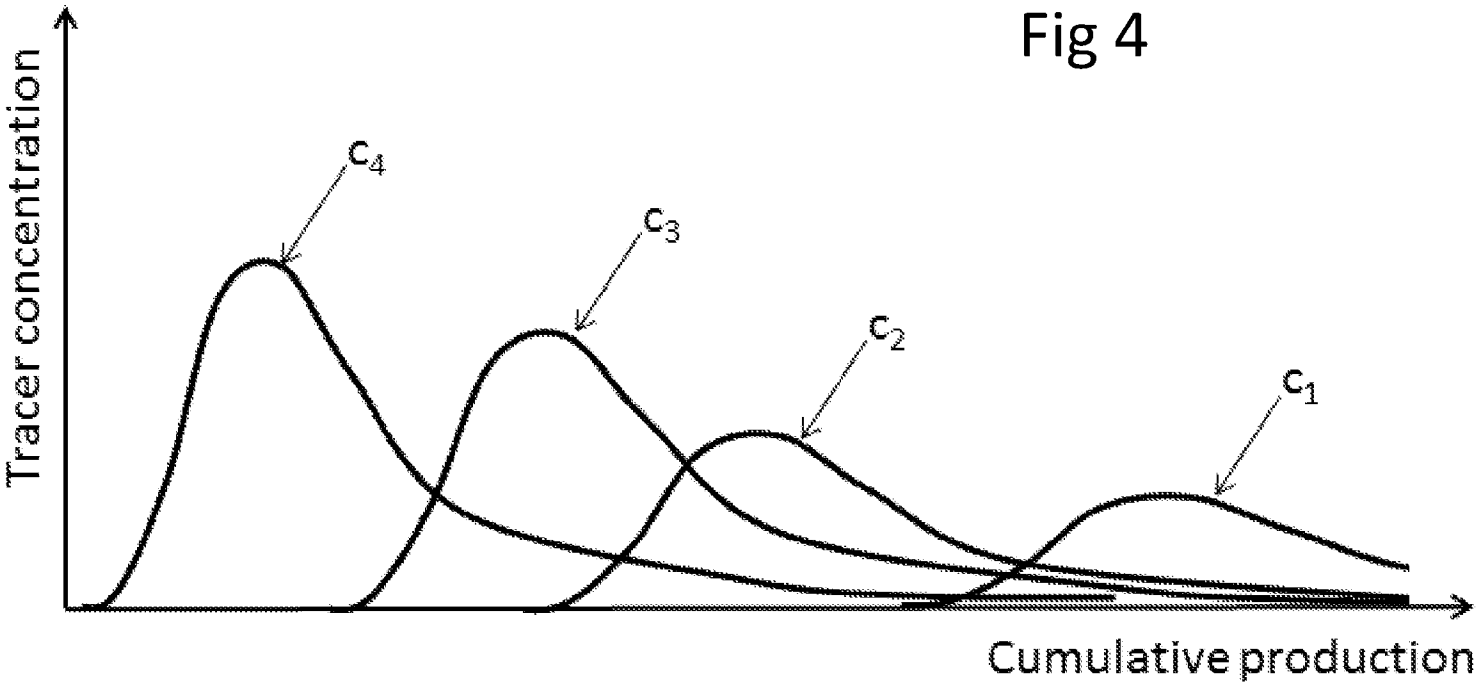
FIG. 4 is a curve diagram for tracer concentrations in the produced fluid (v) as a function of time or cumulative produced volume, and wherein the inner tracer tr1 in the "to" of the well is produced as the last one and is diluted of the above influx zones. Based on such curves one may establish an influx profile for the well as a whole.
Figure 5:
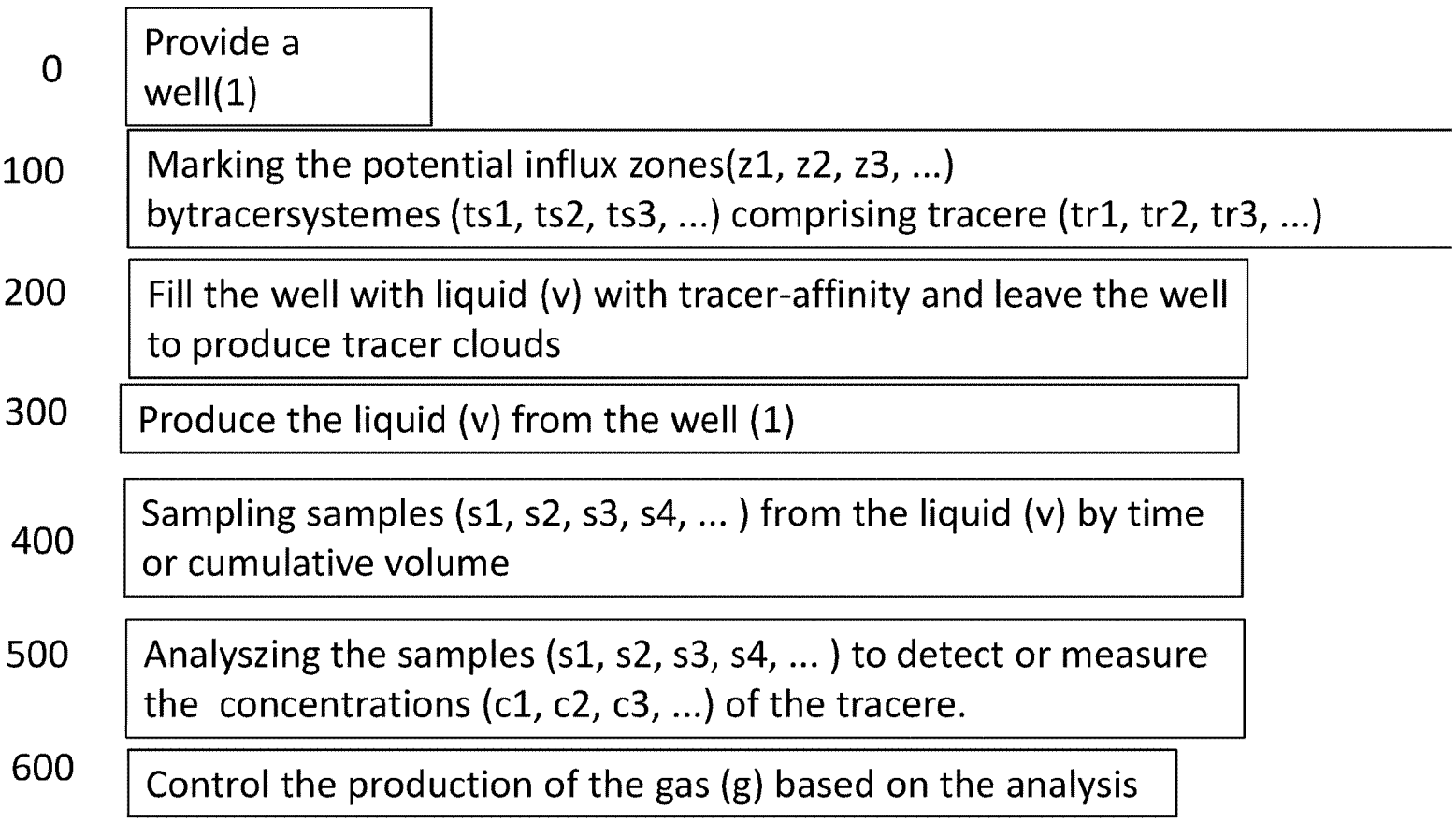
FIG. 5 is a schematic picture of the steps of the method according to the invention.

One has always a certain modelling knowledge of the petroleum well. The model knowledge require that the influx profile in the well may be indicated based on the time or the cumulative volume at the arrival of the different tracers, as illustrated in FIG. 4. The amplitude and the area of the concentration pass for each tracer for every influx zone that is significance to the relative inflow rates in the different zones. What flows in from one influx zone to the production pipe, dilutes the concentrations inflowing upstream. This is examples of parameters that contains in the model of interpreting the concentration pass.

By the well (1) we mean a "mono bore" well or a multilateral well (with more branches).

In an embodiment of the invention there is a special property demand to the tracers:

intelligent release to a so called "target fluid", for instance that we have a tracer that is released to water only and only by water, but that will not be released by the gas that is the subject to the investigation. In such an embodiment of the invention the fact is that the tracers (tr1, tr2, tr3, . . . ) have affinity (201) to the liquid (v), but the tracers (tr1, tr2, tr3, . . . ) do not have affinity to the gas (g). An advantage then will be that the method is "cleaner" due to the fact that the gas is not smearing the tracer before the liquid (v) is pumped in.

In a relatively rudimentary embodiment of the invention the well is drilled, but not completed, i.e. a s so-called "bare-foot" well (1), see FIG. 1, wherein the tracer systems (ts1, ts2, ts3, . . . ) are placed (120) at, or in the well wall (11), i.e. that the zones are marked (120) at or in the well wall (11). This is a situation that generally is limited to drilled wells in well consolidated rock types, due to difficulties by otherwise reliable placing of tracer systems or tracer carriers, but might be used.

Figure 2:
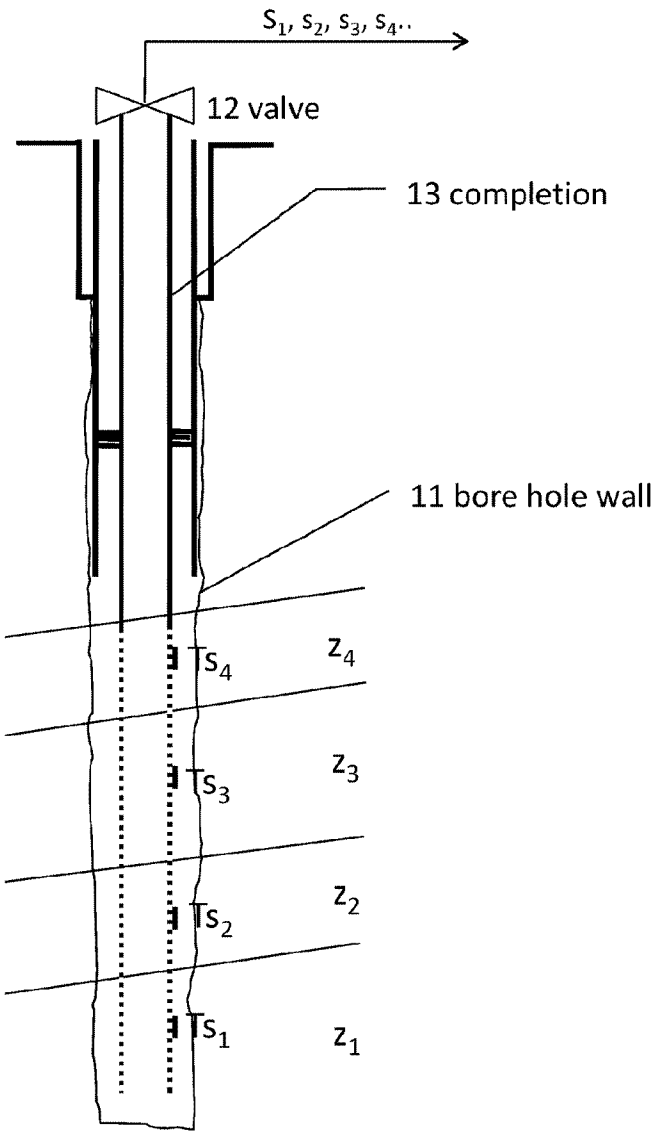
FIG. 2 is a similar vertical section cut of a simple-completed well with a so called "pre-drilled production liner" or "slotted production liner", or "stand alone screen", which have no seals between the influx zones. This allows placing of tracers outside the production bore or in the wall of the production bore instead of inside or at the borehole wall.
Figure 3:
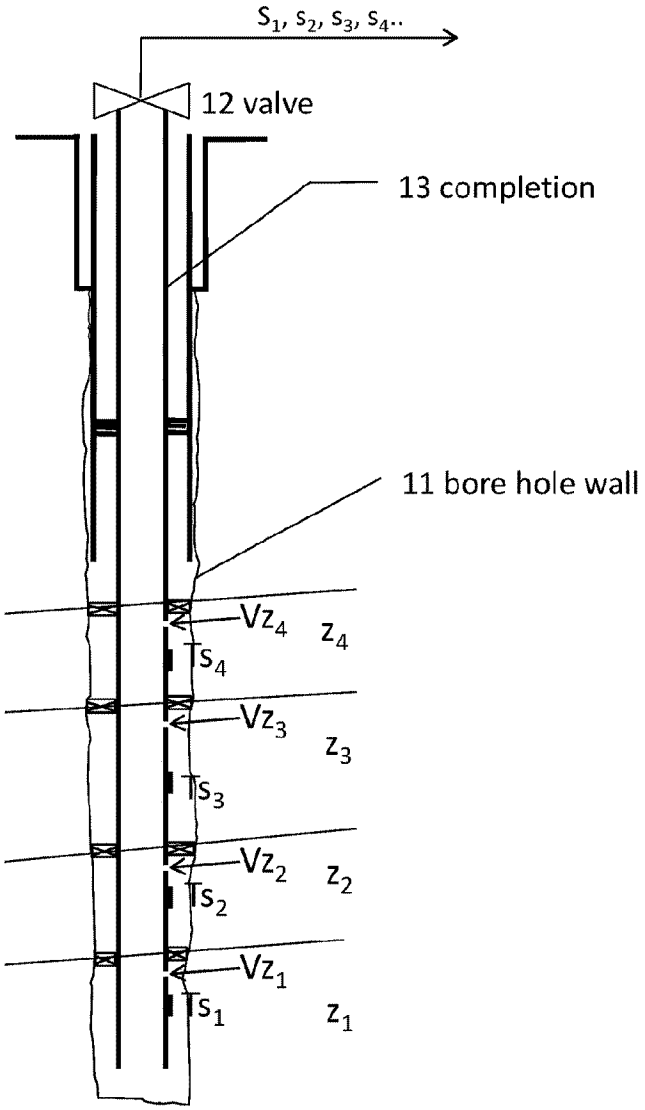
FIG. 3 is a similar vertical section cut of a completed well with four placed tracer systems in or behind the completion or in the rock behind the completion in the influx zones.

In an embodiment of the invention the well is completed, please see FIG. 2 and FIG. 3, i.e. that there is placed a completion (13) in the well, with a production pipe and split into zones by seals (see FIG. 3) and possible valves, so that the well is split according to pressure in different zones (zk1, zk2, zk3, . . . ), and wherein the tracer systems (ts1, ts2, ts3, . . . are placed (110) in separate zones (zk1, zk2, . . . ) of the completion (13).

The method preferably comprises to control (600) the production of the gas (g) after that the liquid (v) is taken out of the well (1), based on the analyzed samples (s1, s2, s3, . . . ). In an embodiment of the invention, where the well is completed and the zones are separated by seals, one may control the production by controlling (610) the valves (vz1, vz2, vz3, . . . ) so as for zone by zone controlling (611) the influx from the influx zones (z1, z2, z3, . . . ).

In an embodiment of the invention, where after filling (200) the liquid into the well, leaving it static (210) for a time to build up "tracer shots" (clouds of tracer molecules) at every tracer system (ts1, ts2, ts3, . . . ). This may be faded during active cross flow, which is before pressure equilibrium, which will to a certain degree prevent formation of such clouds.

An embodiment according to the invention may comprise, during or after filling (200) the liquid into the well also further pressurizes the well, for pressing the liquid (v) somewhat into one or more of the zones (z1, z2, z3, . . . ) in the formations. This may be performed due to at least three reasons:

a) to ensure that no zones (z1, z2, z3, . . . ) will blow gas into the well or the production pipe before the other zones, by each zones in at least the start of the production blow out liquid (v) and not only gas.

b) to ensure that at least the completion (12) or even with a part of the reservoir behind each production zone is wetted by the liquid (v), by flushing or flooding the zones (zi) to ensure wetting and thereby contact between the liquid (v) and the tracers (tr1, tr2, tr3, . . . ). That is one replaces the gas (g) behind each influx zone (zi) by the liquid (v) and by that gets a better contact to each tracer), c) that the entire method shall be carried out with production of a single continuous state of the fluid (v), moving to the surface-continuously, more or less like a piston movement. If a gas pocket is accumulated in between, it will disturb the method and the interpretation will become more difficult.

The invention claimed is:

1. A method for detecting or mapping potential influx zones for gas from a geological formation to a gas well with a well head with a valve tree or a choke, comprising the steps of:

marking each of said potential influx zones with one tracer system having a corresponding tracer;

filling the gas well, from the surface through said well head, with a liquid, wherein said tracers have affinity to said liquid;

after having filled said liquid into said gas well, leaving said gas well static for a time to build up tracer shots at every tracer systems;

producing said liquid from said gas well;

consecutively collecting samples from said produced liquid; and analyzing said collected samples to prove possible presence of one or more of said tracers or even measure said tracers concentrations.

2. The method according to claim 1, wherein said gas well is drilled and there is no hardware completion in said gas well, and wherein said tracer systems are placed at or in a borehole wall of said gas well.

3. The method according to claim 1, wherein a completion is placed in said well, and wherein said tracer systems are placed in separate zones of the completion.

4. The method according to claim 3, further comprising the step of controlling production of said gas based on said analyzed samples after said liquid is produced out of said gas well.

5. The method according to claim 4, wherein the step of controlling production of said gas further comprises adjusting one or more valves for controlling an influx from said potential influx zones in a manner of influx zone by influx zone.

6. The method according to claim 1, wherein said samples are taken of said produced liquid consecutively by cumulative produced liquid volumes or elapsed time.

7. The method according to claim 1, further comprising the step of after filling said liquid into said gas well, continuing pressure-filling the same liquid for increasing a pressure of said gas well, for pressing said liquid further into one or more of said potential influx zones in said geological formations.

8. The method according to claim 1, wherein said tracers have affinity to said liquid, and said tracers do not have affinity to said gas.

* * * * *